US006464830B1

(12) United States Patent
Holz et al.

(10) Patent No.: US 6,464,830 B1
(45) Date of Patent: Oct. 15, 2002

(54) METHOD FOR FORMING A MULTI-LAYERED PAPER WEB

(75) Inventors: Jeffrey D. Holz, Sherwood; Thomas G. Neal, Jr., Appleton, both of WI (US); Robert E. Donnelly, Barrow-in-Furness (GB); Michelle Nault, Battle Creek, MI (US); Devany H. Martin, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/707,535

(22) Filed: Nov. 7, 2000

(51) Int. Cl.[7] ..... D21F 1/02; D21H 27/38

(52) U.S. Cl. ..... 162/130; 162/149; 162/191

(58) Field of Search ..... 162/111, 112, 162/109, 113, 117, 123, 124, 125, 128, 132, 203, 212, 216, 298, 300, 301, 336, 343, 344, 129, 130; 428/154, 156

(56) References Cited

U.S. PATENT DOCUMENTS

| | | | | |
|---|---|---|---|---|
| 1,532,083 A | * | 3/1925 | Shaw | 162/129 |
| 2,881,669 A | * | 4/1959 | Thomas et al. | 162/130 |
| 3,432,936 A | | 3/1969 | Cole et al. | |
| 3,476,644 A | | 11/1969 | Krehnbrink | |
| 3,755,220 A | | 8/1973 | Freimark et al. | |
| 3,821,068 A | | 6/1974 | Shaw | |
| 3,879,257 A | | 4/1975 | Gentile et al. | |
| RE28,459 E | | 7/1975 | Cole et al. | |
| 3,903,342 A | | 9/1975 | Robert, Jr. | |
| 3,923,593 A | * | 12/1975 | Versuput | 162/301 |
| 4,000,237 A | | 12/1976 | Roberts, Jr. | |
| 4,036,684 A | | 7/1977 | Schmitt et al. | |
| 4,061,775 A | | 12/1977 | Dybas et al. | |
| 4,125,659 A | | 11/1978 | Klowak et al. | |
| 4,144,122 A | | 3/1979 | Emanuelsson et al. | |
| 4,158,594 A | | 6/1979 | Becker et al. | |
| 4,166,001 A | | 8/1979 | Dunning et al. | |
| 4,179,330 A | | 12/1979 | Page | |

(List continued on next page.)

FOREIGN PATENT DOCUMENTS

| | | |
|---|---|---|
| CA | 1176886 | 10/1984 |
| CA | 1195562 | 10/1985 |
| CA | 2095554 | 8/1994 |
| CA | 2118529 | 2/1996 |
| EP | 116512 A2 | 2/1984 |
| EP | 347154 B1 | 6/1989 |
| EP | 677612 A2 | 4/1995 |
| FR | 1241054 | 1/1960 |
| GB | 2006296 A | 5/1979 |
| GB | 2057528 A | 4/1981 |
| GB | 2121449 A | 5/1983 |
| GB | 2152961 A | 8/1985 |
| WO | WO8200485 | 8/1981 |
| WO | WO9401620 | 1/1994 |
| WO | WO9501479 | 1/1995 |
| WO | WO9510661 | 4/1995 |
| WO | WO9621768 | 7/1996 |
| WO | WO9621769 | 7/1996 |
| WO | WO963310 | 10/1996 |

OTHER PUBLICATIONS

"Background of Invention" of the Present Application.

*Primary Examiner*—Peter Chin
*Assistant Examiner*—Eric Hug
(74) *Attorney, Agent, or Firm*—Dority & Manning, P.A.

(57) ABSTRACT

A multi-layered paper web that has increased strength for minimizing slough and lint is provided. In one embodiment, the paper web contains an outer layer formed from unrefined hardwood fibers and an inner layer formed from refined hardwood, softwood, and machine broke fibers. During formation. within a headbox, the outer and inner fibrous layers are allowed to partially blend. By partially blending the layers, the fibers within each layer can form bonds in the -z direction to provide sufficient strength to minimize lint and slough.

22 Claims, 1 Drawing Sheet

U.S. PATENT DOCUMENTS 4,208,459 A 6/1980 Becker et al.
4,225,382 A 9/1980 Kearney et al.
4,300,981 A 11/1981 Carstens
4,326,000 A 4/1982 Roberts, Jr.
4,351,699 A 9/1982 Osborn, III
4,384,130 A 5/1983 Martin
4,420,372 A 12/1983 Hostetler
4,425,186 A 1/1984 May et al.
4,432,833 A 2/1984 Breese
4,436,587 A * 3/1984 Andersson ..... 162/123
4,441,962 A 4/1984 Osborn, III
4,447,294 A 5/1984 Osborn, III
4,448,638 A 5/1984 Klowak
4,464,224 A 8/1984 Matolcsy
4,481,243 A 11/1984 Allen
4,482,429 A 11/1984 Klowak
4,488,932 A 12/1984 Eber et al.
4,507,173 A 3/1985 Klowak et al.
4,513,051 A 4/1985 Lavash
4,608,292 A 8/1986 Lassen
4,701,237 A 10/1987 Lassen
4,720,383 A 1/1988 Drach et al.
4,795,530 A 1/1989 Soerens et al.
4,859,527 A 8/1989 DiStefano et al.
4,894,118 A 1/1990 Edwards et al.
4,940,513 A 7/1990 Spendel
4,942,077 A 7/1990 Wendt et al.
4,963,230 A 10/1990 Kawase et al.
4,986,882 A 1/1991 Mackey et al.
5,048,589 A 9/1991 Cook et al.
5,059,282 A 10/1991 Ampulski et al.
5,098,519 A 3/1992 Ramasubramanian et al.
5,098,979 A 3/1992 O'Lenick, Jr.
5,129,988 A * 7/1992 Farrington, Jr. ..... 162/123
5,147,505 A 9/1992 Altman
5,164,045 A 11/1992 Awofeso et al.
5,164,046 A 11/1992 Ampulski et al.
5,215,626 A 6/1993 Ampulski et al.
5,217,576 A 6/1993 Van Phan
5,223,096 A 6/1993 Phan et al.
5,228,954 A 7/1993 Vinson et al.
5,240,562 A 8/1993 Phan et al.
5,246,545 A 9/1993 Ampulski et al.
5,246,546 A 9/1993 Ampulski
5,262,007 A 11/1993 Phan et al.
5,264,082 A 11/1993 Phan et al.
5,277,761 A 1/1994 Van Phan et al.
5,279,767 A 1/1994 Phan et al.
5,312,522 A 5/1994 Van Phan et al.
5,334,286 A 8/1994 Van Phan et al.
5,354,425 A 10/1994 Mackey et al.
5,385,642 A 1/1995 Van Phan et al.
5,385,643 A 1/1995 Ampulski
5,389,204 A 2/1995 Ampulski
5,397,435 A 3/1995 Ostendorf et al.
5,399,241 A 3/1995 Oriaran et al.
5,399,412 A 3/1995 Sudall et al.
5,405,501 A 4/1995 Phan et al.
5,415,737 A 5/1995 Phan et al.
5,427,696 A 6/1995 Phan et al.
5,437,766 A 8/1995 Van Phan et al.
5,443,691 A 8/1995 Phan et al.
5,474,689 A 12/1995 Laughlin et al.
5,487,813 A 1/1996 Vinson et al.
5,492,598 A 2/1996 Hermans et al.
5,494,554 A 2/1996 Edwards et al.
5,494,731 A 2/1996 Fereshtehkhou et al.
5,505,818 A 4/1996 Hermans et al.
5,510,000 A 4/1996 Phan et al.
5,510,001 A 4/1996 Hermans et al.
5,510,002 A 4/1996 Hermans et al.
5,527,560 A 6/1996 Fereshtehkhou et al.
5,529,665 A 6/1996 Kaun
5,538,595 A 7/1996 Trokhan et al.
5,543,067 A 8/1996 Phan et al.
5,552,020 A 9/1996 Smith et al.
5,558,873 A 9/1996 Funk et al.
5,562,805 A 10/1996 Kamps et al.
5,573,637 A 11/1996 Ampulski et al.
5,575,891 A 11/1996 Trokhan et al.
5,578,170 A 11/1996 Erikson et al.
5,591,306 A 1/1997 Kaun
5,595,828 A 1/1997 Weber et al.
5,601,871 A * 2/1997 Krzysik et al. ..... 427/288
5,614,293 A 3/1997 Krzysik et al.
5,622,786 A 4/1997 Weber et al.
5,690,788 A * 11/1997 Marinack et al. ..... 162/113
5,759,926 A 6/1998 Pike et al.
5,814,188 A 9/1998 Vinson et al.
5,830,317 A 11/1998 Vinson et al.
5,895,710 A 4/1999 Sasse et al.
5,958,185 A * 9/1999 Vinson et al. ..... 162/111
6,096,152 A 8/2000 Anderson et al.
6,149,769 A 11/2000 Mohammadi et al.

* cited by examiner

METHOD FOR FORMING A MULTI-LAYERED PAPER WEB

BACKGROUND OF THE INVENTION

Tissue products such as paper towels, facial tissue, bath tissue, and other similar products have been formed in a variety of ways. A tissue product often has more than one layer to impart certain properties to the product. For example, the products may be formed from a multilayered paper web having an outer layer that gives the web a relatively soft feel. A variety of techniques have traditionally been used to form such multi-layered paper webs.

For example, some multi-layered webs have been formed by fully blending short fibers and long fibers to form an outer layer of the web. Moreover, other tissue products, such as described in U.S. Pat. No. 4,300,981 to Carstens, have been formed by utilizing primarily short fibers to form the outer layer so that the purity of the resulting short fiber outer layer can be substantially maintained. However, in some instances, minimal mixing has occurred within the layers such that 5% or less of the fibers within one layer comes from the fibers of an adjacent layer.

However, one problem associated with such conventional methods for forming multi-layered webs is that the webs do not have sufficient softness and/or strength. In particular, many of the conventional webs are soft, but lack sufficient strength in the -z direction. As a result, some fibers within the outer layer can break away from the web, thereby causing lint and slough.

As such, a need currently exists for an improved method of forming a paper web that is soft, but also possesses sufficient strength in the -z direction.

SUMMARY OF THE INVENTION

The present invention is generally directed to a method of forming a multi-layered paper web. In particular, the method of the present invention includes partially blending a first fibrous layer containing hardwood fibers with a second fibrous layer containing hardwood fibers and softwood fibers. Other fiber furnishes may also be utilized if desired.

In some embodiments, some of the fibers may be refined prior to forming the paper web. Refining can generally impart at least some strength to the web without substantially deteriorating bulk and/or stiffening the web. For example, one type of refining technique known as fibrillation can be utilized. When the fibers are refined, the extent of refinement can generally vary.

To form a paper web, in one embodiment, the fibers are supplied to a headbox that distributes the fibers to a papermaking machine. In one embodiment, to separate the fibers into layers, a headbox is provided that can include one or more dividers. For example, in one embodiment, a three-layered headbox is utilized that includes dividers that do not completely extend to the slice opening. In some instances, the dividers can be positioned so that the tips of the dividers are at least about 0.25 inches from the end of the slice opening, particularly from about 0.5 inches to about 10 inches, and more particularly between about 0.5 inches to about 7 inches.

In one embodiment, one layer within the headbox includes hardwood fibers and an adjacent layer within the headbox includes hardwood fibers and softwood fibers. Other headbox layers and/or fibrous materials may also be utilized. For example, in one embodiment, a three-layered headbox can include an outer layer containing hardwood fibers, an inner layer containing hardwood fibers and softwood fibers, and another outer layer containing softwood fibers and hardwood fibers.

In some embodiments, it may be desired that the fibrous layers be provided in approximately equal weights to aid in processing. For example, in some embodiments, a two-layered headbox has two fibrous layers that each are about 40% to about 60% of the weight of all the fibrous layers, particularly between about 45% to about 55%, and more particularly about 50%. Moreover, in other embodiments, a first fibrous layer containing hardwood fibers can be between about 30% to about 50% of the weight of all the fibrous layers, particularly between about 35% to about 45%, and more particularly about 40%. In addition, a second and third fibrous layer containing hardwood fibers and softwood fibers can each be about 20% to about 40% of the weight of all the fibrous layers, particularly between about 25% to about 35%, and more particularly about 30%.

In accordance with the present invention, the fibers from a first fibrous layer containing hardwood fibers can be partially blended with the fibers from a second fibrous layer containing softwood fibers and hardwood fibers. For example, in one embodiment, the fibrous layers are partially blended within a headbox. Once partially blended, the resulting web is formed with an outer layer having from about 5% to about 20% by weight of softwood fibers, particularly from about 5% to about 15%, and more particularly 10% to about 15% by weight of softwood fibers, which originate from the second fibrous layer.

By partially blending the fibers of one layer with the fibers of another layer, the resulting multi-layered paper web can have improved strength and yet remain soft. For example, partial blending can promote bonding of the fibers in the -z direction, thereby inhibiting the production of lint and slough, which typically results from weak -z directional bonds.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
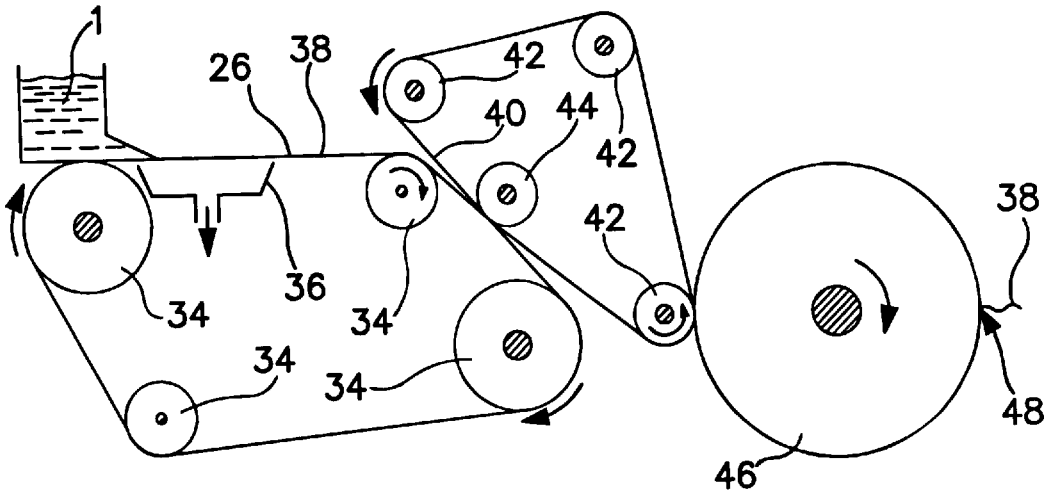
FIG. 1 is a schematic diagram of one embodiment of a papermaking machine used to form a multi-layered paper web.

Repeat use of reference characters in the present specification and drawings is intended to represent same or analogous features or elements of the present invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a method of forming a multi-layered paper web that can have good softness and strength characteristics. For example, in one embodiment, the present invention is directed to a method that includes the steps of partially blending one fibrous layer with another fibrous layer within a headbox to promote fiber bonding in the -z direction.

Multi-layered paper webs formed in accordance with the present invention can generally be formed from any of a variety of materials. In particular, a variety of natural and/or synthetic fibers can be used. For example, some suitable natural fibers can include, but are not limited to, nonwoody fibers, such as abaca, sabai grass, milkweed floss fibers, pineapple leaf fibers; softwood pulp fibers, such as northern and southern softwood kraft fibers. Other illustrative examples of suitable softwood pulps include southern pines, red cedar, hemlock, black spruce, and mixtures thereof. Exemplary commercially available softwood pulp fibers suitable for the present invention include those available from Kimberly-Clark Corporation under the trade designations "Longlac-19". Northern softwood kraft fibers, such as the fibers described above, generally have a fiber length of about 1.8 mm to about 2.5 mm. Softwood fibers can, in some embodiments, further enhance the strength of the web.

In addition, hardwood pulp fibers, such as eucalyptus, maple, birch, or aspen, can be utilized. Eucalyptus fibers, for instance, which are typically from about 0.8 to 1.2 mm in length, provide uniform formation and greatly increase the softness of the web. Moreover, machine broke fibers (i.e., internally recycled fibers) may also be used. Furnishes including other types of recycled fibers, such as from newsprint, reclaimed paperboard, and office waste, may also be used. Further, some synthetic fibers, such as rayon fibers, ethylene vinyl alcohol copolymer fibers, and polyolefin fibers, can be used in some instances.

To form the multi-layered paper web, one or more fiber furnishes are first typically provided. For instance, in one embodiment, at least two fiber furnishes can be utilized. Although other fibers may be utilized, the first fiber furnish typically contains hardwood fibers, such as eucalyptus fibers. Moreover, the second fiber furnish can contain hardwood fibers, softwood fibers (e.g., northern or southern softwood kraft fibers), machine broke (i.e., internally recycled fibers), combinations thereof, and the like. In one embodiment, for example, the second fiber furnish contains softwood and hardwood fibers.

If desired, more than two fiber furnishes may also be utilized. For example, in one embodiment, a third fiber furnish containing machine broke fibers is utilized. The above fiber furnishes can then be fed at to pulpers that disperse the fibers into individual fibers. The pulpers can run continuously or in a batch format to supply fibers to the papermaking machine.

Once a batch of fibers has been dispersed, the furnish can then, in some embodiments, be pumped to a dump chest and diluted to about a 3–4% consistency. For example, in one embodiment, the first fiber furnish containing hardwood fibers is transferred to a dump chest. Thereafter, the first fiber furnish is transferred directly to a clean stock chest, where it is diluted to a consistency of about 2–3%. If desired, the clean stock chest can be maintained at a relatively constant level to allow the continuous addition of a treatment, such as a softening agent, to enhance the properties of the finished product.

In other embodiments, one or more of the fiber furnishes may be refined prior to being utilized in the paper web. For example, in one embodiment, the second fiber furnish containing hardwood and softwood fibers is transferred to a blend chest, where a third fiber furnish containing broke fibers can be mixed therewith. The proportion of broke is typically dictated by performance specifications and current broke storage levels. Once fully blended, in one embodiment, the softwood fibers, hardwood fibers, and broke fibers, are then transferred to a refiner.

Refining can generally impart at least some web strength without substantially deteriorating bulk and/or stiffening the web. For example, one type of refining technique known as fibrillation can be utilized. Fibrillation generally refers to the random splitting of fibers into minute fibrous elements or fibrils. Fibrillation can be accomplished through mechanical agitation, such as described in U.S. Pat. No. 4,608,292 to Lassen or U.S. Pat. No. 4,701,237 to Lassen, which are incorporated herein in their entirety by reference thereto, as well as through other methods, such as by contacting the fibers with a fibrillation-inducing medium. For instance, U.S. Pat. No. 5,759,926 to Pike et al., U.S. Pat. No. 5,895,710 to Sasse et al., and U.S. Pat. No. 5,935,883 to Pike, which are incorporated herein in their entirety by reference thereto, describe a variety of fibrillation-inducing mediums that can be used in the present invention, such as hot water, steam, air/steam mixtures, etc.

When the fibers are refined, as described above, the extent of refinement can generally vary. In fact, any amount of refinement can provide at least some increase in strength. In some embodiments, for example, the fibers are refined to an extent such that the resulting fibers have a Canadian Standard Freeness ("CSF") (TAPPI T227m-58) between about 400 CSF to about 800 CSF, and more particularly, between about 500 CSF to about 700 CSF. Canadian Standard Freeness is generally a measurement of the drainage properties of fibers as a result of refinement. For example, 800 CSF represents a relatively low amount of pulp refinement, while 400 CSF represents a relatively high amount of pulp refinement.

Thereafter, the fiber furnishes can then be pumped from the refiner or chest to a low density cleaner that can decrease the consistency to about 0.6%. If desired, various dry and/or wet strength agents can also be added to improve the sheet integrity. The furnishes can further be diluted, if desired, to about 0.1% consistency at the fan pump prior to entering the headbox.

To form a paper web, the furnishes are then supplied to a headbox for distribution to a papermaking machine. In general, any headbox capable of forming a. multi-layered web in accordance with the present invention can be utilized.

Figure 2:
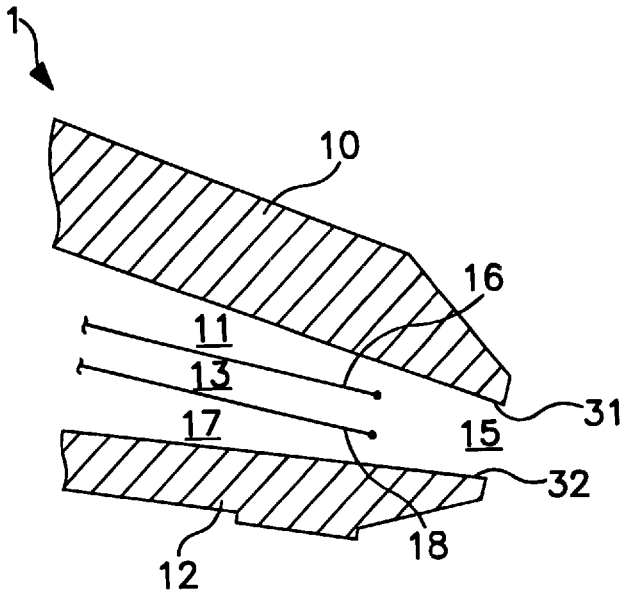
FIG. 2 is a cross-sectional view of one embodiment of a headbox that can be used to form a multi-layered paper web.

One particular embodiment of a headbox for forming a multi-layered web in accordance with the present invention is illustrated in FIG. 2. For instance, a headbox 1 is provided for issuing a free jet (not shown) of fibers. The angle of impingement of the free jet and its point of impact can vary for different processes and forming geometries. The fibers are deposited onto a forming wire while water is removed, such as through combinations of gravity, centrifugal force, or vacuum suction.

Referring to FIG. 2, the headbox 1 is depicted in more detail. In particular, as shown, the headbox 1 is three-layered and includes an upper head box wall 10 that ends at an upper headbox lip 31 and a lower head box wall 12 that ends at a lower headbox lip 32. The space between the upper headbox lip 31 and the lower headbox lip 32 is sometimes referred to as a slice opening 15. As shown, the headbox 1 is divided into layers 11, 13, and 17 by a first divider 16 and a second divider 18. However, although the embodiment depicted and described herein contains two dividers, it should be understood that any number of dividers can be utilized in the present invention to form a multi-layered paper web. For instance, one divider can be used to form a two-layered web of the present invention.

In general, the dividers 16 and 18 used in the headbox 1 can be made from any of a variety of materials and can be located in a variety of positions. For example, the dividers can be made of rigid and/or flexible materials, such as described in U.S. Pat. No. 5,129,988 to Farrington, Jr., which is incorporated herein in its entirety by reference thereto. Moreover, the dividers may be positioned at any desired angle so that the fibrous layers converge or diverge as they flow through the headbox. Further, the dividers can also be formed so that the tips of the dividers do not completely extend to the end of the slice opening 15. For example, in some embodiments, the dividers are positioned so that the tips of the dividers are at least about 0.25 inches from the end of the slice opening 15, particularly from about 0.5 to about 10 inches, and particularly from about 0.5 to about 7 inches.

In general, the fibrous layers formed within the headbox 1 can contain a variety of fibers, such as described above. For instance, in one embodiment, an unrefined layer of hardwood fibers can be formed within the outer layer 11 of the headbox 1. In addition, a refined layer of softwood fibers and hardwood fibers, such as described above, can be formed within the inner layer 13 of the headbox 1. In some embodiments, another refined layer can also be formed within the outer layer 17 of the headbox 1. However, it should be understood that the layers described above are but one embodiment of the present invention, and that the fibrous layers formed within the outer layers 11 and 17 and the inner layer 13 of the headbox 1 may also be made from a variety of other fibrous materials. For example, in one embodiment, the fibrous layer formed within the inner layer 13 and the outer layer 17 of the headbox 1 may contain softwood, hardwood, and broke fibers.

In general, the fibrous layers formed within the headbox 1 can be provided in any desired proportion. In some embodiments, it is desired that the fibrous layers be provided in approximately equal weights to aid in processing. For example, when using two fibrous layers, the weight of each fibrous layer can be between about 40% to about 60% of the weight of all the fibrous layers, particularly between about 45% to about 55%, and more particularly about 50%. Moreover, when containing three layers, such as shown in FIG. 2, the fibrous layer formed within the outer layer 11 of the headbox 1 can be between about 30% to about 50% of the weight of all the fibrous layers, particularly between about 35% to about 45%, and more particularly, about 40%. In addition, the fibrous layers formed within the inner layer 13 and outer layer 17 of the headbox 1 can each be about 20% to about 40% of the weight of all the fibrous layers, particularly between about 25% to about 35%, and more particularly, about 30%.

In accordance with the present invention, the fibers from the fibrous layer formed within the outer layer 11 of the headbox 1 can be "partially blended" with the fibers from the fibrous layer formed within the inner layer 13 of the headbox 1. For instance, in one embodiment, the fibers can be "partially blended" at the slice opening 15 of the headbox 1 due to the length of the dividers 16 and 18. As used herein, the phrase "partially blending" or "partially blended" generally refers to the controlled intermixing of two or more fibrous layers. For example, in one embodiment, the fibrous layer formed within the outer layer 11 contains hardwood fibers and the fibrous layer formed within the inner layer 13 contains both softwood and hardwood fibers. Once partially blended within the headbox 1, however, the resulting web is formed with an outer layer having from about 5% to about 20% by weight of softwood fibers, particularly from about 5% to about 15%, and more particularly from about 10% to about 15% by weight of softwood fibers, which originate from the fibrous layer formed within the inner layer 13. However, it should be understood that such partial blending need not occur within the headbox 1. For example, the fibrous layers can be partially blended at other stages in the papermaking process as well.

By partially blending. the fibers of one fibrous layer with the fibers of another fibrous layer, a multi-layered paper web can be formed that has improved strength and softness. For example, partial blending allows a portion of the softwood fibers contained within the fibrous layer formed within the inner layer 13 of the headbox 1 to migrate to the fibrous layer formed within the outer layer 11 of the headbox 1. Thus, in addition to hardwood fibers, the fibrous layer formed within the outer layer 11 also contains a small portion of softwood fibers, which provides some strength in the x-y plane to the fibrous layer formed within the outer layer 11 without having a substantial affect on the softness provided by the hardwood fibers. Moreover, as a result of partial blending, it is believed that the softwood fibers of the fibrous layer formed within the outer layer 11 maintain a relatively large amount of hydrogen bonding with softwood and other fibers remaining in the fibrous layer formed within the inner layer 13. Such hydrogen bonding promotes strength in the -z direction of the web, thereby inhibiting the production of lint and slough, which typically results from weak -z directional bonds.

After the free jet of fibers is deposited by the headbox 1, any suitable technique or process can be used to produce a paper or tissue web. For example, the papermaking process can utilize creping, embossing, wet-pressing, through-drying, through-dry creping, uncreped through-drying, double creping, winding, finishing, as well as other steps in forming the multi-layered paper web. For example, techniques, such as disclosed in U.S. Pat. No. 4,300,981 to Carstens; U.S. Pat. No. 5,048,589 to Cook, et al.; U.S. Pat. No. 5,399,412 to Sudall. et al., U.S. Pat. No. 5,494,554 to Edwards. et al., and U.S. Pat. No. 5,785,813 to Smith. et al., which are incorporated herein in their entirety by reference thereto, can be utilized.

Referring to FIG. 1, for example, one embodiment of a paper making machine is illustrated which is capable of receiving the stratified fibrous furnishes from the headbox 1 and forming a paper web. As shown, in this embodiment, a forming fabric 26 is supported and driven by a plurality of guide rolls 34. A vacuum box 36 is disposed beneath forming fabric 26 and is adapted to remove water from the fibrous layers to assist in forming a web.

From the forming fabric 26, a formed web 38 is transferred to a second fabric 40, which may be either a wire or a felt. The fabric 40 is supported for movement around a continuous path by a plurality of guide rolls 42. Also included is a pick up roll 44 designed to facilitate transfer of web 38 from fabric 26 to fabric 40.

From the fabric 40, a web 38, in this embodiment, is transferred to the surface of a rotatable heated dryer drum 46, such as a Yankee dryer. The web 38 is lightly pressed into engagement with the surface of dryer drum 46 to which it adheres, due to its moisture content and its preference for the smoother of the two surfaces. In some cases, however, a creping adhesive, such as an ethylene vinyl acetate, can be applied over the web surface or drum surface for facilitating attachment of the web to the drum.

As the web 38 is carried through a portion of the rotational path of the dryer surface, heat is imparted to the web causing most of the moisture contained within the web to be evaporated. The web 38 is then removed from dryer drum 46 by a creping blade 48. Although optional, creping the web 38 as it is formed further reduces internal bonding of the fibers within an outer layer of a web, thereby increasing softness. However, because of the additional -z directional bonds formed as described above, the outer layer of the web can retain sufficient strength after creping to minimize lint and slough.

If desired, the paper web 38 can then, in some embodiments, be pulled through a curing or drying station (not shown). The drying station can include any form of a heating unit, such as an oven energized by infrared heat, microwave energy, hot air or the like. The drying station may be, in some instances, be used to dry the web and/or cure the bonding agents. Once drawn through the drying station, the web 38 can be wound into a roll of material or fed directly to further processing stations.

A variety of other chemical treatments can also be applied to the paper web in any manner during any stage of the papermaking process. Examples of some suitable treatments include, but are not limited to, wet strength agents, dry strength agents, softening agents, refining agents, antioxidants, antimicrobial agents, colorants, emollients, external analgesics, humectants, moisturizing agents, etc. Moreover, such chemical treatments can be applied at any stage during the papermaking process, such as described in U.S. Pat. No. 5,785,813 to Smith. et al.

A multi-layered paper web made in accordance with the present invention can generally have a variety of beneficial properties. For instance, the web can be soft, yet also possess sufficient strength for reducing lint and slough. For example, in one embodiment, the web has an outer layer of hardwood fibers partially blended with a layer of hardwood and softwood fibers. This partial blending can promote bonding and strength in the -z direction between the outer fibrous layer and an inner fibrous layer. Typically, such enhanced -z directional strength is also not substantially deteriorated after creping.

Furthermore, by providing a web with layers of relatively balanced weight, the uniformity of the cross-deckle profile of the web can also be improved. As used herein, the phrase "cross-deckle profile" generally refers to the weight and strength of a paper web in the cross-direction at various points along a selected cross-section of the web. A web with a relatively uniform cross-deckle profile can allow the tissue product to be processed more easily, which further allows the useful properties of the tissue product to be better balanced.

The multi-layered paper webs formed according to the present invention can be incorporated into a variety of tissue products. For example, in one embodiment of the present invention, a single-ply tissue product can be formed from a multi-layered paper web made according to the present invention. In another embodiment, a tissue product can be formed to have three plies wherein at least one of the plies is a multi-layered paper web formed according to the present invention. In some embodiments, the basis weight of the tissue products can range from about 5 grams per square meter to about 100 grams per square meter, and particularly between about 10 grams per square meter to about 60 grams per square meter.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of forming a multi-layered paper web, said method comprising the steps of:

providing a first layer of a first fibrous material, said first fibrous material containing hardwood fibers;

providing a second layer of a second fibrous material, said second fibrous material containing hardwood fibers and softwood fibers; and partially blending within a headbox said first layer with said second layer such the resulting first layer contains between about 5% to about 20% by weight softwood fibers originating from said second fibrous material and such that the resulting second layer contains fibers originating from said first fibrous material.

2. A method as defined in claim 1, further comprising the step of refining at least a portion of the fibers contained within said second fibrous material.

3. A method as defined in claim 1, wherein said second fibrous material contains machine broke fibers.

4. A method as defined in claim 1, wherein said first layer comprises between about 45% to about 55% of the combined weight of said first and second layers and said second layer comprises between about 45% to about 55% of the combined weight of said first and second layers.

5. A method as defined in claim 1, further comprising the step of forming a third layer of a third fibrous material, said third fibrous material containing hardwood fibers and softwood fibers.

6. A method as defined in claim 5, wherein said first layer comprises between about 35% to about 45% of the combined weight of said first, second, and third layers, said, second layer comprises between about 25% to about 35% of the combined weight of said first, second, and third layers, and said third layer comprises between about 25% to about 35% of the combined weight of said first, second, and third layers.

7. A method as defined in claim 1, wherein said resulting first layer contains between about 5% to about 15% by weight softwood fibers originating from said second fibrous material.

8. A method as defined in claim 1, wherein said resulting first layer contains about 10% to about 15% by weight softwood fibers originating from said second fibrous material.

9. A method of forming a multi-layered paper web, said method comprising the steps of:

providing a first layer of a first fibrous material, said first fibrous material containing hardwood fibers;

providing a second layer of a second fibrous material, said second fibrous material containing hardwood fibers and softwood fibers;

refining at least a portion of the fibers contained within said second fibrous material;

partially blending within a headbox said first layer with said second layer such the resulting first layer contains between about 5% to about 20% softwood fibers originating from said second fibrous material and such that the resulting second layer contains fibers originating from said first fibrous material.

10. A method as defined in claim 9, wherein said second fibrous material contains machine broke fibers.

11. A method as defined in claim 9, wherein said first layer comprises between about 45% to about 55% of the combined weight of said first and second layers and said second layer comprises between about 45% to about 55% of the combined weight of said first and second layers.

12. A method as defined in claim 9, further comprising the step of forming a third layer of a third fibrous material, said third fibrous material containing hardwood fibers and softwood fibers.

13. A method as defined in claim 12, wherein said first layer comprises between about 35% to about 45% of the combined weight of said first, second, and third layers, said second layer comprises between about 25% to about 35% of the combined weight of said first, second, and third layers, and said third layer comprises between about 25% to about 35% of the combined weight of said first, second, and third layers.

14. A method as defined in claim 9, wherein said first layer contains between about 5% to about 15% by weight softwood fibers originating from said second fibrous material.

15. A method as defined in claim 9, wherein said first layer contains about 10% to about 15% by weight softwood fibers originating from said second fibrous material.

16. A method of forming a multi-layered paper web, said method comprising the steps of:

providing a first layer of a first fibrous material, said first fibrous material containing hardwood fibers;

providing a second layer of a second fibrous material, said second fibrous material containing hardwood fibers and softwood fibers;

providing a third layer of a third fibrous material; and partially blending within a headbox said first layer, said second layer, and said third layer such that the resulting first layer contains between about 5% to about 20% by weight softwood fibers originating from said second fibrous material, the resulting second layer contains fibers originating from said first fibrous material, and the resulting third layer contains fibers originating from said second fibrous material.

17. A method as defined in claim 16, wherein said second fibrous material contains machine broke fibers.

18. A method as defined in claim 16, wherein said first layer comprises between about 35% to about 45% of the combined weight of said first, second, and third layers, said second layer comprises between about 25% to about 35% of the combined weight of said first, second, and third layers, and said third layer comprises between about 25% to about 35% of the combined weight of said first, second, and third layers.

19. A method as defined in claim 16, wherein said resulting first layer contains between about 5% to about 15% by weight softwood fibers originating from said second fibrous material.

20. A method as defined in claim 16, wherein said resulting first layer contains about 10% to about 15% by weight softwood fibers originating from said second fibrous material.

21. A method as defined in claim 16, wherein said third fibrous material contains hardwood fibers and softwood fibers.

22. A method as defined in claim 16, further comprising refining at least a portion of the fibers contained within said second fibrous material.

* * * * *